United States Patent [19]

Louris et al.

[11] Patent Number: 4,686,367

[45] Date of Patent: Aug. 11, 1987

[54] METHOD OF OPERATING QUADRUPOLE ION TRAP CHEMICAL IONIZATION MASS SPECTROMETRY

[75] Inventors: John N. Louris, West Lafayette, Ind.; John E. P. Syka, Sunnyvale; Paul E. Kelley, San Jose, both of Calif.

[73] Assignee: Finnigan Corporation, San Jose, Calif.

[21] Appl. No.: 773,339

[22] Filed: Sep. 6, 1985

[51] Int. Cl.[4] ..... H01J 49/42

[52] U.S. Cl. ..... 250/290; 250/291; 250/282

[58] Field of Search ..... 250/292, 291, 290, 281, 250/282, 293

[56] References Cited

U.S. PATENT DOCUMENTS 4,540,884 9/1985 Stafford et al. ..... 250/282

OTHER PUBLICATIONS

Ghaderi et al., Anal. Chem. 53, 1981, pp. 428–437.

Lawson et al., J. Phys. E.: Scientific Instruments, vol. 6, 1973, pp. 357–362.

Bonner et al., Adv. Mass Spec. 6, 1974, pp. 377–384.

*Primary Examiner*—Craig E. Church

*Assistant Examiner*—Jack I. Berman

*Attorney, Agent, or Firm*—Flehr, Hohbach, Test, Albritton & Herbert

[57] ABSTRACT

The method of performing chemical ionization and mass analysis with a quadrupole ion trap.

5 Claims, 18 Drawing Figures

METHOD OF OPERATING QUADRUPOLE ION TRAP CHEMICAL IONIZATION MASS SPECTROMETRY

The present invention relates to a method of using an ion trap for chemical ionization mass spectrometry.

Ion trap mass spectrometers, or quadrupole ion stores, have been known for many years and described by a number of authors. They are devices in which ions are formed and contained within a physical structure by means of electrostatic fields such as RF, DC and a combination thereof. In general, a quadrupole electric field provides an ion storage region by the use of a hyperbolic electrode structure or a spherical electrode structure which provides an equivalent quadrupole trapping field.

Mass storage is generally achieved by operating the trap electrodes with values of RF voltage V, its frequency f, DC voltage U and device size $r_0$ such that ions having their mass-to-charge ratios within a finite range are stably trapped inside the device. The aforementioned parameters are sometimes referred to as scanning parameters and have a fixed relationship to the mass-to-charge ratios of the trapped ions. For trapped ions, there is a distinctive secular frequency for each value of mass-to-charge ratio. In one method for detection of the ions, these secular frequencies can be determined by a frequency tuned circuit which couples to the oscillating motion of the ions within the trap, and then the mass-to-charge ratio may be determined by use of an improved analyzing technique.

In spite of the relative length of time during which ion trap mass spectrometers and methods of using them for mass analyzing a sample have been known they have not gained popularity until recently because these mass selection techniques are insufficient and difficult to implement and yield poor mass resolution and limited mass range. A new method of ion trap operation U.S. Pat. No. 4,540,884 has overcome most of the past limitations and is gaining popularity as a product called the Ion Trap Detector.

The present invention is directed to performing chemical ionization and mass spectrometry with a quadrupole ion trap mass spectrometer. Chemical ionization mass spectrometry (CI) has been widely used by analytical chemists since its introduction in 1966 by Munson and Field, J. Amer. Chem. Soc. 88, 2621 (1966). In CI mass spectrometry ionization of the sample of interest is effected by gas-phase ion/molecule reactions rather than by electron impact, photon impact, or field ionization/desorption. CI offers the capability of controlling sample fragmentation through the choice of appropriate reagent gas. In particular, since fragmentation is often reduced relative to that obtained with electron impact simple spectra can often be obtained with enhanced molecular weight information.

The relatively short ion residence times in the sources of conventional CI mass spectrometers necessitates high reagent gas pressures (0.1–1 torr) for significant ionization of the sample. To overcome this and other disadvantages, various approaches have been used to increase residence times of ions in the source so that the number of collisions between sample neutral molecules and the reagent ions is increased prior to mass analysis.

Among these techniques, ion cyclotron resonance (ICR) has seen increasing use. Since the high pressures needed in conventional CI sources can not be used in most ICR equipment (because the analyser region requires a very high vacuum), the source region must be maintained at a low pressure. Gross and co-workers have demonstrated the feasibility of obtaining CI mass spectra by the ICR technique with the reagent gas in the low $10^{-6}$ torr range and the analyte in the $10^{-7}$ to $10^{-8}$ torr range. (Ghaderi, Kulkarni, Ledford, Wilkins and Gross, Anal. Chem., 53,428 (1981)). These workers allowed a reaction period after ionization for the formation of reagent ions and the subsequent reaction with the sample neutrals. For example, for methane at $2\times10^{-6}$ torr, the relative proportion of $CH_5+$ to $C_2H_5+$ became constant after 100 ms. So, when methane ($P=2\times10^{-6}$ torr, was the reagent gas, CI by Fourier transform ICR was obtained by introducing a low partial pressure of sample (e.g., $5\times10^{-8}$torr), ionizing via electron impact, waiting for a 100 ms reaction period, and detecting by using the standard Fourier transform ICR technique. Since the sample is present at a concentration of 1% of the reagent gas, significant electron impact ionization of the analyte does occur.

Todd and co-workers have used the quadrupole ion storage trap as a source for a quadrupole mass spectrometer. (Lawson, Bonner and Todd, J. Phys E. 6,357 (1973)). The ions were created within the trap under RF-only storage conditions so that a wide mass range was stored. The ions then exited the trap because of space-charge repulsion (or were ejected by a suitable voltage pulse to one of the end-caps) and were mass-analyzed by a conventional quadrupole. In either case, in the presence of a reagent gas the residence time was adequate to achieve chemical ionization. Of course, since the sample is also present during the ionization period, EI fragments may appear in the spectrum with this method.

In the present work we demonstrate a mode of operation for the quadrupole ion storage trap to obtain CI mass spectra that offers advantages over the methods previously used with quadrupole traps and the methods previously reported for ICR instruments. The quadrupole ion trap is used for both the reaction of neutral sample molecules with reagent ions and for mass analysis of the products. Fragments from electron impact of the analyte can be suppressed by creating conditions within the trap under which reagent ions are stored during ionization but most analyte ions are not.

It is an object of this invention to provide a new method of operating an ion trap in a CI mode of operation.

It is another object of the present invention to provide a method of operating an ion trap for both reaction of sample neutrals with sample ions or reagent ions and for mass analysis of the products.

In accordance with the above objects, there is provided a new method of using an ion trap in a CI mode which comprises the steps of introducing analyte and reaction molecules into the ion trap having a three dimensional quadrupole field in which low mass ions are stored, ionizing the mixture whereby only low mass reagent ions and low mass analyte ions are trapped, allowing the reagent ions and molecules to react and thereafter changing the three dimensional field to allow the products of reactions between the analytic molecules and the reactant ions to be trapped and scanning the three dimensional field to successively eject these product ions and detecting these product ions.

Figure 1:
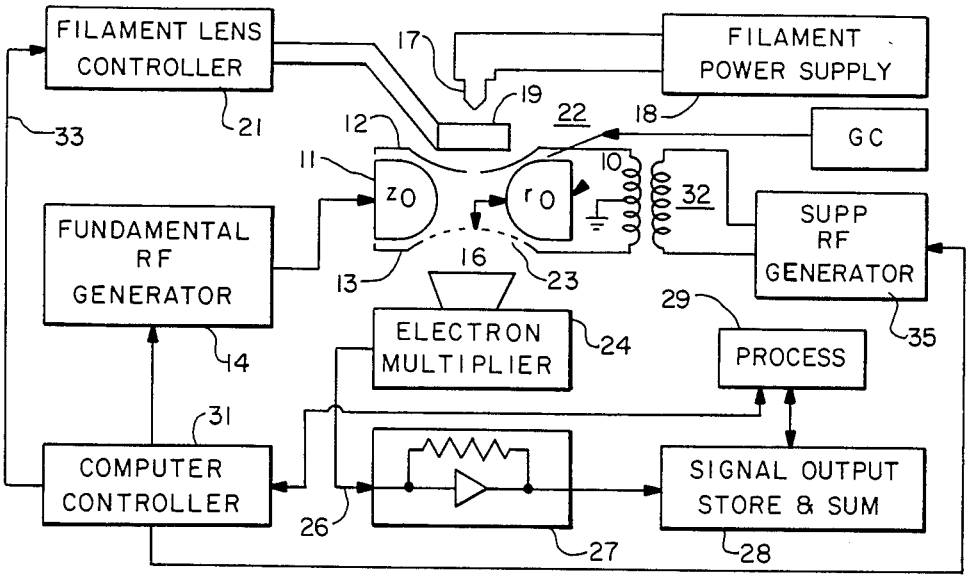
FIG. 1 is a simplified schematic of a quadrupole ion trap along with a block diagram of associated electrical circuits adapted to be used according to the method embodying the present invention.

There is shown in FIG. 1 at 10 a three-dimensional ion trap which includes a ring electrode 11 and two end caps 12 and 13 facing each other. A radio frequency voltage generator 14 is connected to the ring electrode 11 to supply a radio frequency voltage V cos it (the fundamental voltage) between the end caps and the ring electrode which provides the quadrupole field for trapping ions within the ion storage region or volume 16 having a radius $r_0$ and a vertical dimension $z_0$ ($z_0^2 = r_0^2/2$). The field required for trapping is formed by coupling the RF voltage between the ring electrode 11 and the two end cap electrodes 12 and 13 which are common mode grounded through coupling transformer 32 as shown. A supplementary RF generator 35 is coupled to the end caps 12, 13 to supply a radio frequency voltage $V_2 \cos \omega_2 t$ between the end caps electrodes 12 and 13 which are axial resonant frequencies. A filament 17 which is fed by a filament power supply 18 is disposed to provide an ionizing electron beam for ionizing the sample molecules introduced into the ion storage region 16. A cylindrical gate electrode and lens 19 is powered by a filament lens controller 21. The gate electrode provides control to gate the electron beam on and off as desired. End cap 12 includes an aperture through which the electron beam projects. The opposite end cap 13 is perforated 23 to allow unstable ions in the fields of the ion trap to exit and be detected by an electron multiplier 24 which generates an ion signal on line 26. An electrometer 27 converts the signal on line 26 from current to voltage. The signal is summed and stored by the unit 28 and processed in unit 29. Controller 31 is connected to the fundamental RF generator 14 to allow the magnitude and/or frequency of the fundamental RF voltage to be varied for providing mass selection. The controller 31 is also connected to the supplementary RF generator 35 to allow the magnitude and/or frequency of the supplementary RF voltage to be varied or gated. The controller on line 33 gates the filament lens controller 21 to provide an ionizing electron beam only at time periods other than the scanning interval. Mechanical and operating details of ion trap are described in U.S. Patent application Ser. No. 454,351 assigned to the present assignee.

Figure 2:
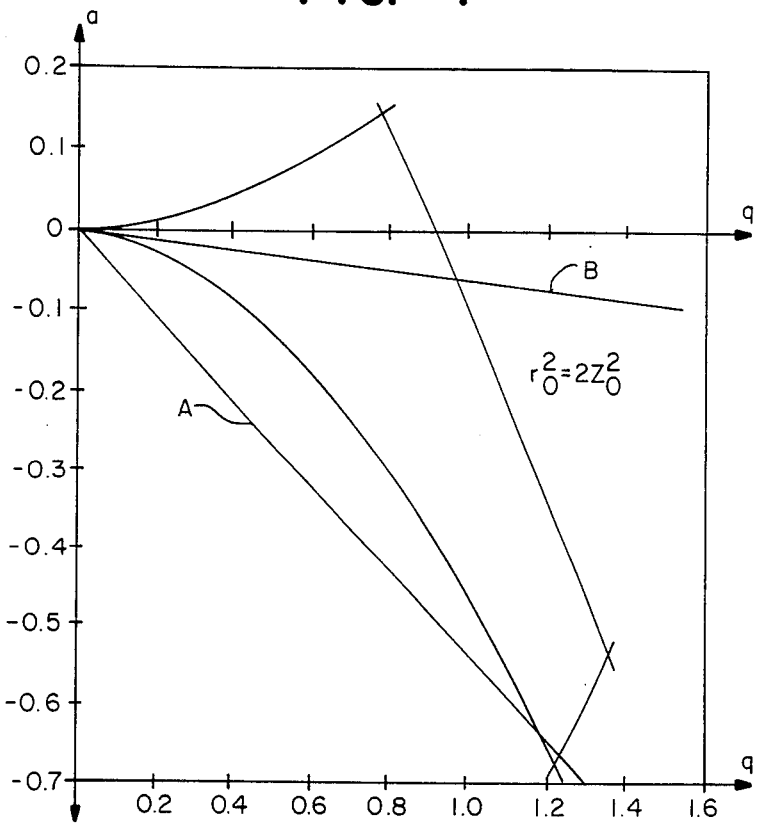
FIG. 2 is a stability envelope for an ion store device of the type shown in FIG. 1.

The symmetric three dimensional fields in the ion trap 10 lead to the well known stability diagram shown in FIG. 2. The parameters a and q in FIG. 2 are defined as:

$$a = -8eU/mr_0^2\omega^2$$

$$q = 4eU/mr_0^2\omega^2$$

where e and m are respectively charge on and mass of charged particle. For any particular ion, the values of a and q must be within the stability envelope if it is to be trapped within the quadrupole fields of the ion trap device.

The type of trajectory a charged particle has in a described three-dimensional quadrupole field depends on how the specific mass of the particle, m/e, and the applied field parameters, U, V, $r_0$ and $\omega$ combined to map onto the stability diagram. If the scanning parameters combine to map inside the stability envelope then the given particle has a stable trajectory in the defined field. A charged particle having a stable trajectory in a three-dimensional quadrupole field is constrained to an orbit about the center of the field. Such particles can be thought of as trapped by the field. If for a particle m/e, U, V, $r_0$ and $\omega$ combine to map outside the stability envelope on the stability diagram, then the given particle has an unstable trajectory in the defined field. Particles having unstable trajectories in a three-dimensional quadrupole field obtain displacements from the center of the field which approach infinity over time. Such particles can be thought of escaping the field and are consequently considered untrappable.

For a three-dimensional quadrupole field defined by U, V, $r_O$ and $\omega$, the locus of all possible mass-to-charge ratios maps onto the stability diagram as a single straight line running through the origin with a slope equal to $-2U/V$. (This locus is also referred to as the scan line.) That portion of the loci of all possible mass-to-charge ratios that maps within the stability region defines the region of mass-to-charge ratios particles may have if they are to be trapped in the applied field. By properly choosing the magnitude of U and V, the range of specific masses to trappable particles can be selected. If the ratio of U to V is chosen so that the locus of possible specific masses maps through an apex of the stability region (line A of FIG. 2) then only particles within a very narrow range of specific masses will have stable trajectories. However, if the ratio of U to V is chosen so that the locus of possible specific masses maps through the middle of the stability region (line B of FIG. 2) then particles of a broad range of specific masses will have stable trajectories.

According to the present invention the ion trap is operated in the chemical ionization mode as follows: Reagent gases are introduced into the trap at pressures between $10^{-8}$ and $10^{-3}$ torr and analytic gases are introduced into the ion trap at pressures between $10^{-5}$ and $10^{-8}$ torr. Both the reagent and analytic gases are at low pressures in contrast to conventional chemical ionization. The reagent and analytic molecules are ionized with the three dimensional trapping field selected to store only low mass reagent and analytic ions. The low mass reagent ions and reagent neutral molecules interact to form additional ions. The low mass ions are stored in the ion trap. The reagent ions interact with analytic molecules to form analytic ion fragments. The three dimensional field is then changed to thereby store higher mass analytic ions formed by the chemical ionization reaction between the reagent ions and the analytic molecules. The stored fragment analytic ions are then ejected by changing the three dimensional field whereby analytic ions of increasing mass are successively ejected. For example, since methane reagent gas mostly produces ions of molecular weight less than 30, the RF and DC potentials on the trap may be adjusted so that during ionization only species of less than m/z 30 will be trapped. A suitable delay period after ionization will allow the formation of reagent ions ($CH_5+$ and $C_2H_5+$, and then the conditions in the trap can be changed so that both the reagent ions and any analyte ions that may form will be trapped. The products can then be analyzed by mass-selective ejection from the trap.

In particular, we find that during storage in the three dimensional field in the RF-only mode that at sufficiently low RF values, high molecular weight ions are not efficiently trapped. So, at low RF voltages only the low mass ions are stored. For methane chemical ionization, one may ionize in RF-only mode with a low RF voltage and only the reagent ions (and low molecular weight analyte ions) will be trapped. After a suitable reaction period to produce $CH_5+$ and $C_2H_5+$, the RF level may be raised to a value that will trap most ions of interest. After a reaction period to allow reagent ions to interact with analytic molecules to form analyte ions, the products are mass-analyzed by scanning the RF voltage and successively ejecting the product ions to give a CI mass spectrum.

Figure 3:
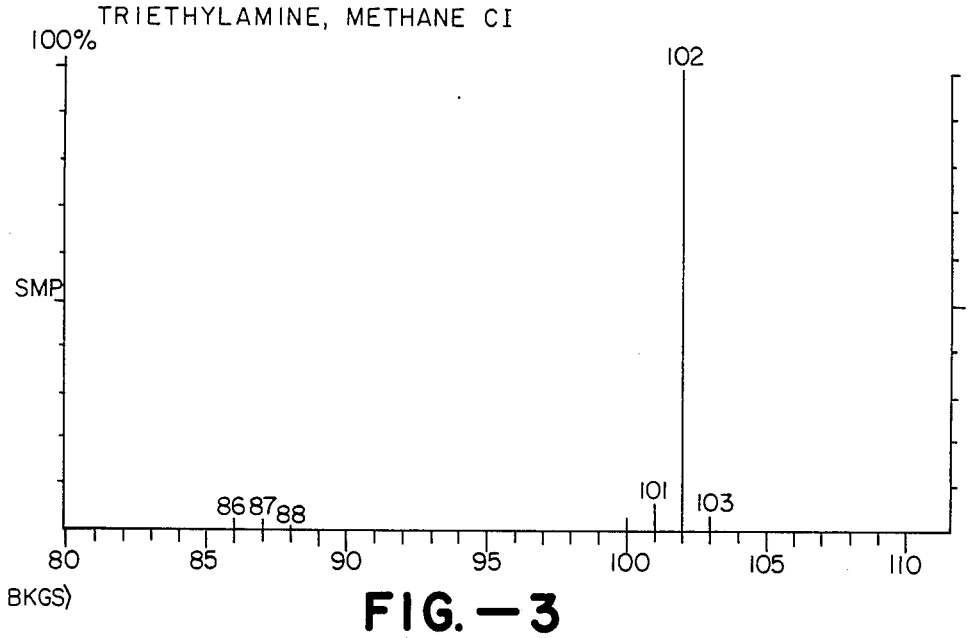
FIG. 3 shows the CI spectrum for triethylamine with methane as the reagent.

FIG. 3 shows a methane chemical ionization spectrum of triethylamine, a compound which shows little molecular ion under electron impact conditions. The spectrum obtained for the analyte (triethylamine) pressure $1\times10^{-6}$ torr, methane pressure $2\times10^{-5}$ torr, He pressure about $2.5\times10^{-3}$ torr shows a large M+1 peak with little fragmentation.

Figure 4:
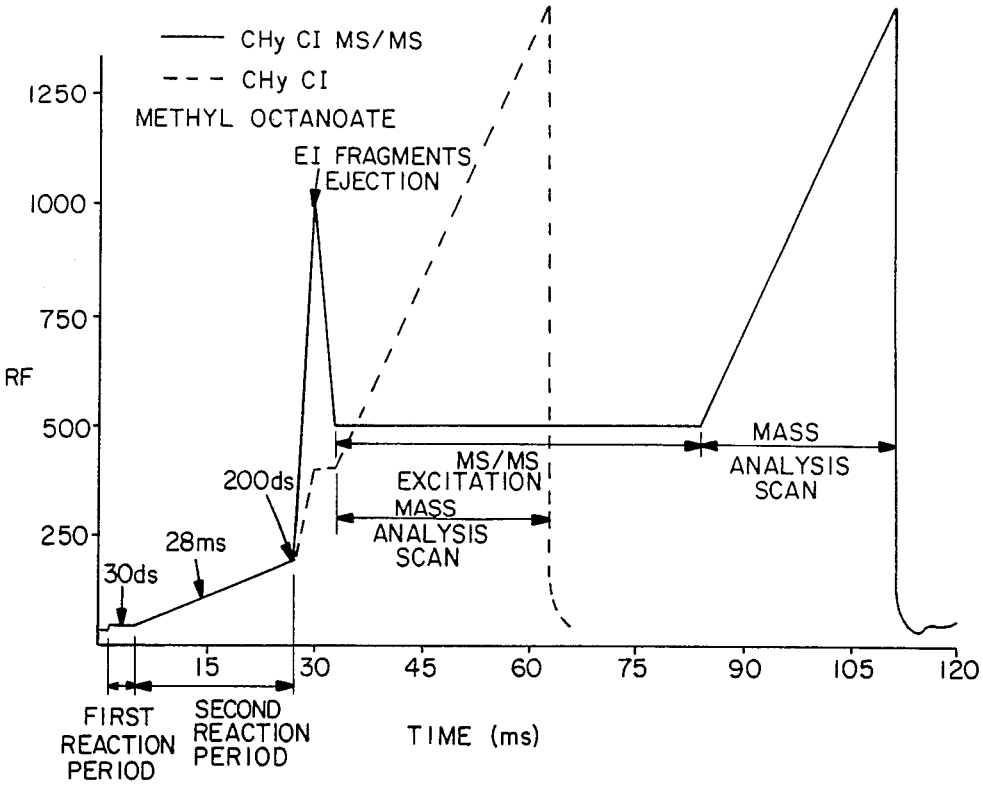
FIG. 4 shows the CI and ms/ms scan program for an ion trap mass spectrometer.

FIG. 4 shows the RF scan-programs used in one embodiment of the present invention. The reagent ions are produced in the first reaction period and the analyte ions are formed during the second reaction period. Alternatively, once the analyte ions have formed, they may be subjected to ms/ms by the method described, in copending application Ser. No. 738,018 assigned to a common assignee, and shown in the solid line, FIG. 4. Briefly, during the period marked "ms/ms excitation," an AC voltage is applied across the end-caps at the resonant frequency of the ion to be investigated. This effects collision-included dissociation, and the products are analyzed in the usual way.

Figure 5:
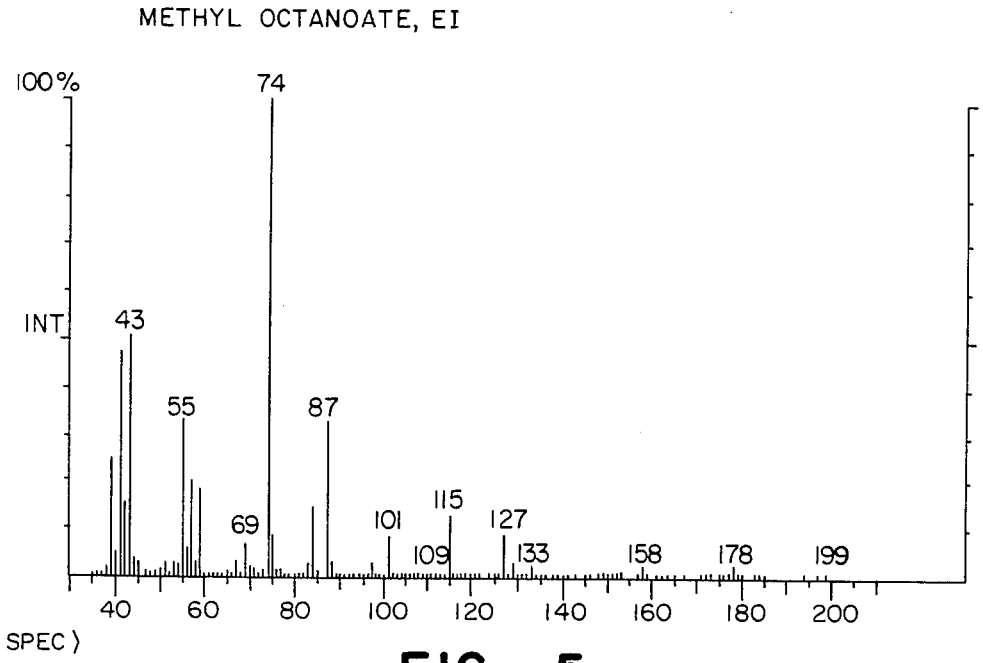
FIG. 5 shows the EI spectrum of methyl octanoate.
Figure 6:
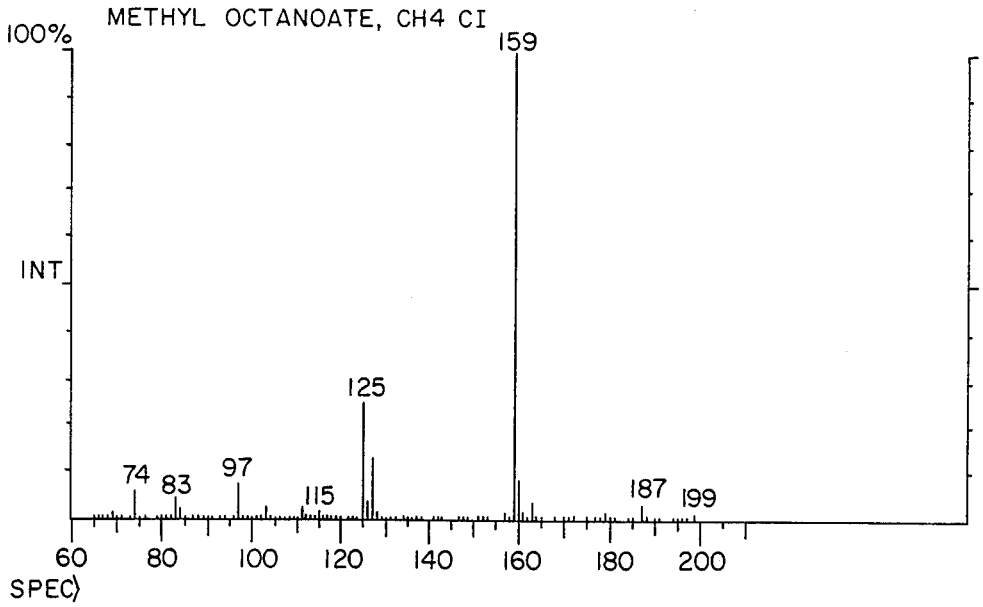
FIG. 6 shows the CI spectrum of methyl octanoate with $CH_4$ reagent.
Figure 7:
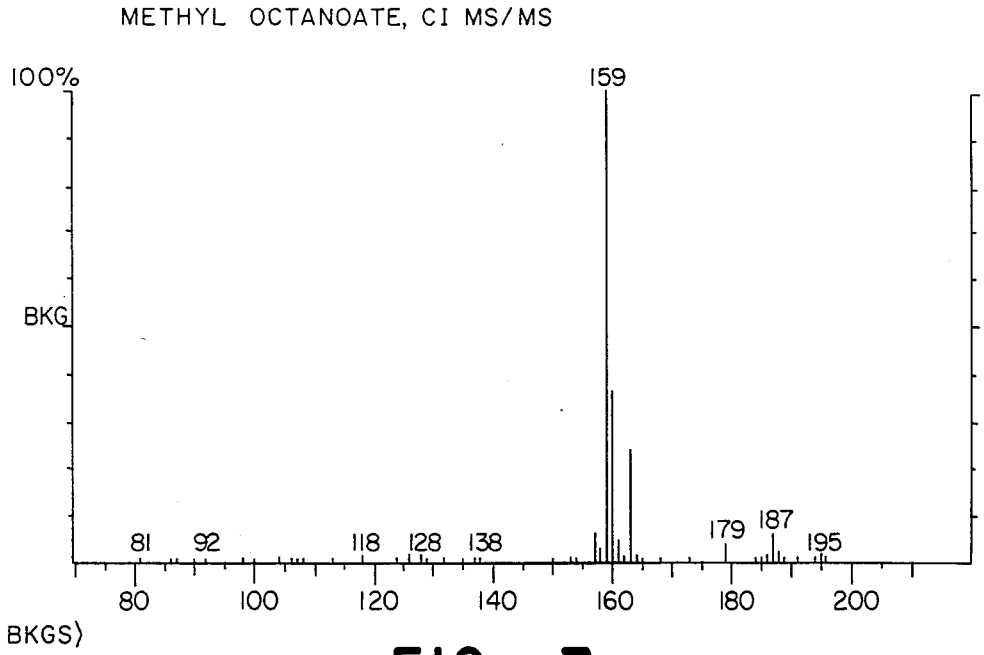
FIG. 7 shows the CI, ms/ms spectrum for methyl octanoate with $CH_4$ reagent.
Figure 8:
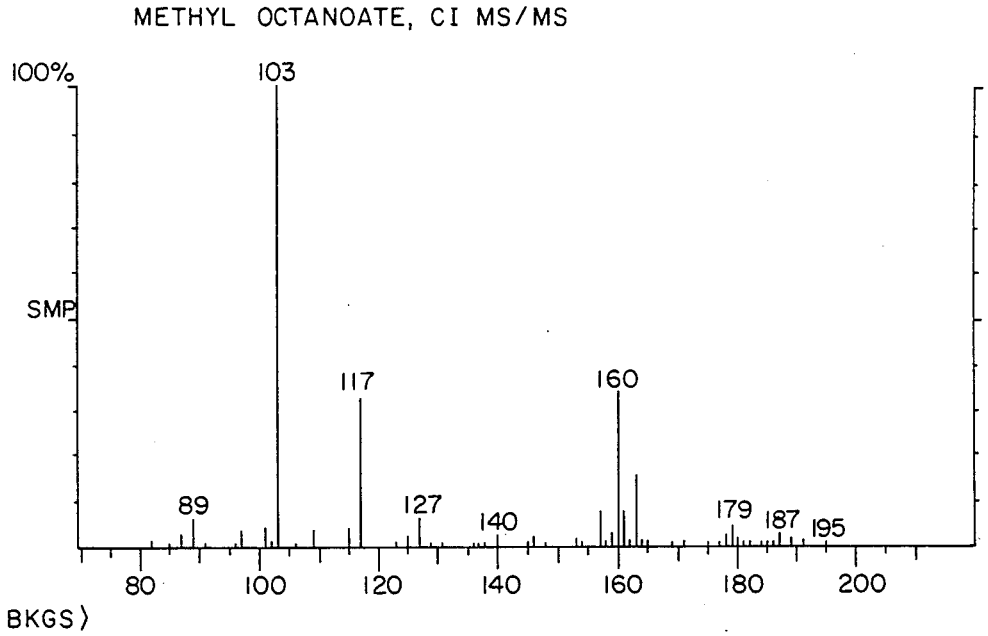
FIG. 8 shows the CI ms/ms spectrum of methyl octanoate with $CH_4$ reagent with an AC voltage at the resonant frequency of m/z 159.

FIG. 5 shows an electron impact spectrum of methyl octanoate, and FIG. 6 shows the corresponding methane CI spectrum obtained under the conditions shown in FIG. 4. Again, the M+1 ion is very prominent in the CI spectrum. FIG. 7 shows the result of the ms/ms RF program of FIG. 4, except that no excitation voltage is used, and FIG. 8 uses the same RF-program as FIG. 7, but an AC Voltage at the resonant frequency of m/z 159 was applied to produce an ms/ms spectrum.

Figure 9:
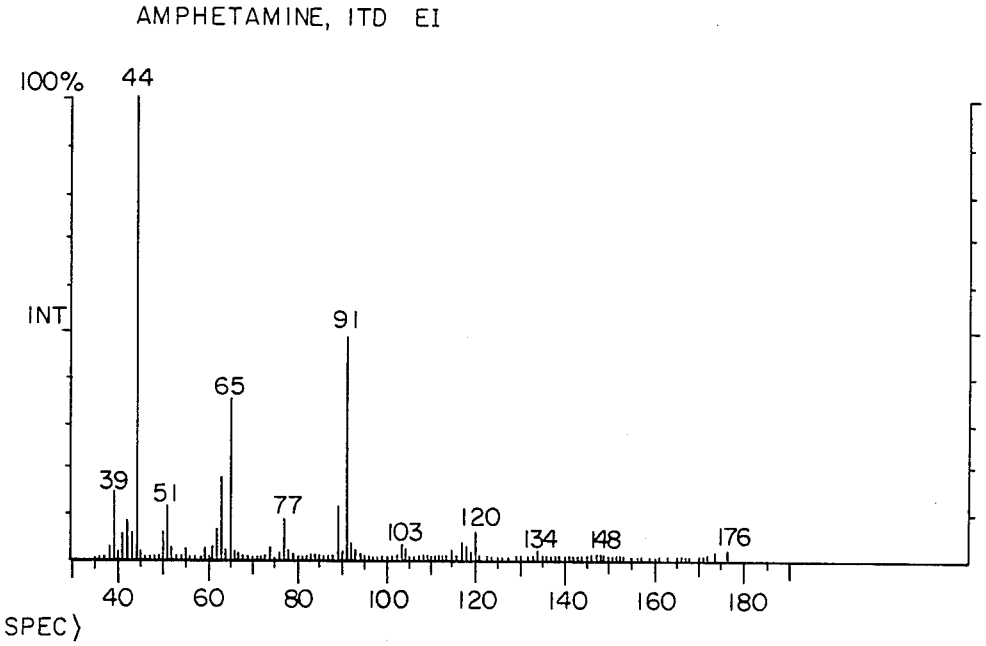
FIG. 9 shows the EI spectrum of amphetamine.
Figure 10:
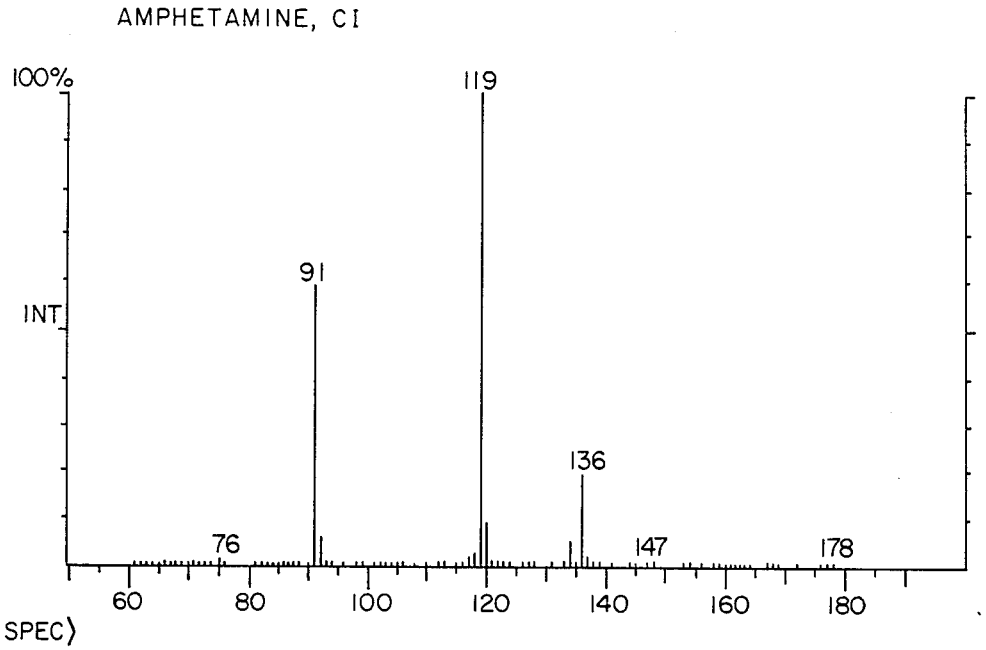
FIG. 10 shows the CI spectrum of amphetamine with methane as the reagent.
Figure 11:
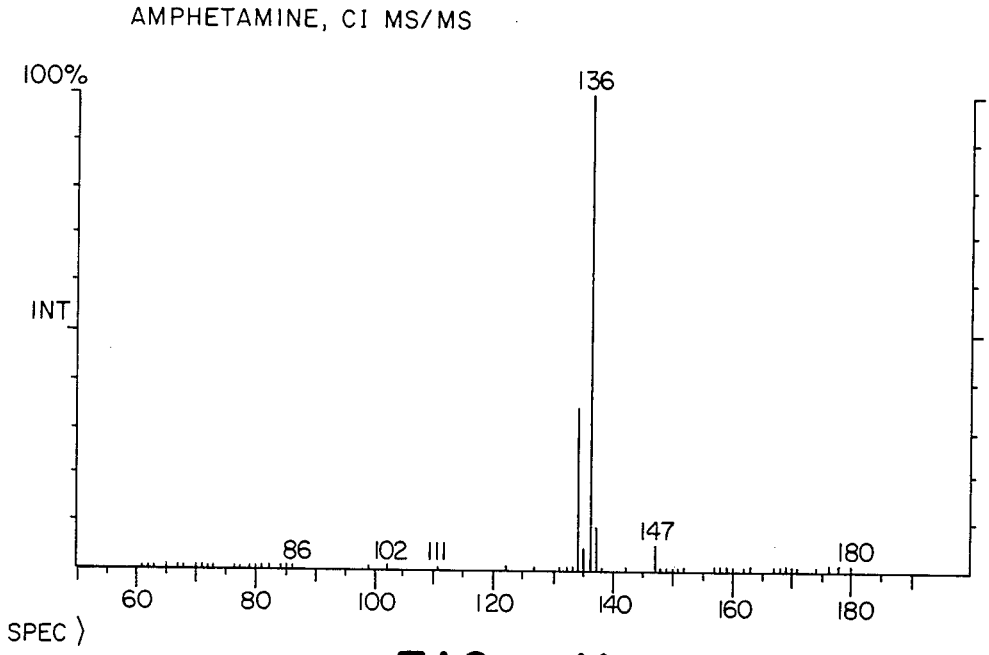
FIG. 11 shows the CI ms/ms spectrum for amphetamine with methane reagent.
Figure 12:
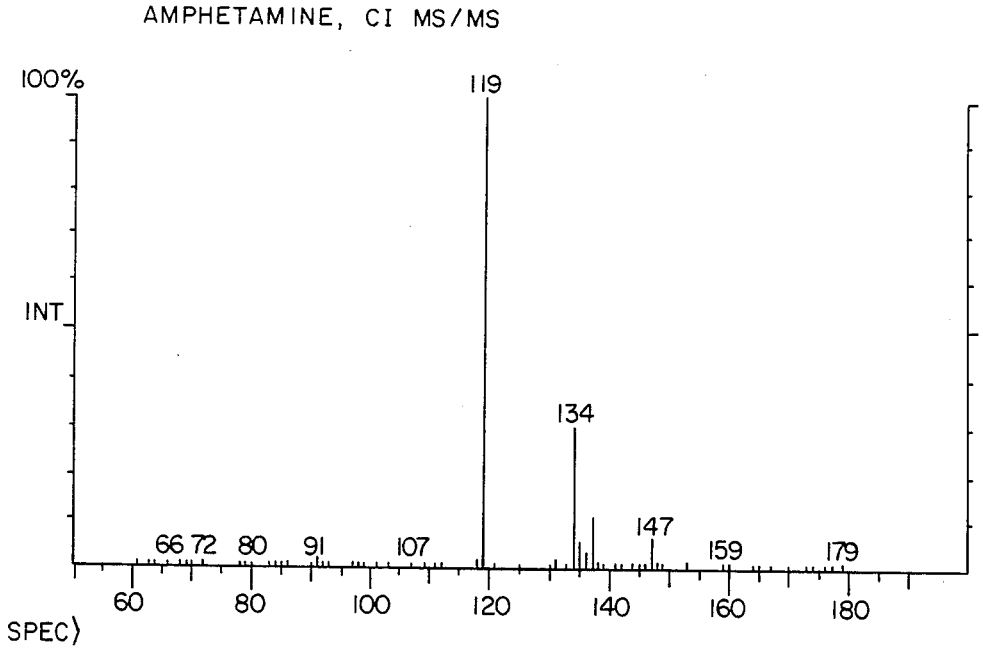
FIG. 12 shows the CI, ms/ms spectrum of amphetamine with methane reagent and an AC voltage at the resonant frequency of m/z 136.

Similarly, FIG. 9 shows an electron impact spectrum of amphetamine (molecular weight 135 $\mu$), in which very little molecular ion is present. FIG. 10 is the corresponding methane CI spectrum, and FIG. 11 uses the ms/ms RF program but without an excitation voltage. FIG. 12 uses the same RF-programs as FIG. 11, but an excitation voltage at the resonant frequency of m/z 136 was applied to produce an ms/ms spectrum.

Figure 13:
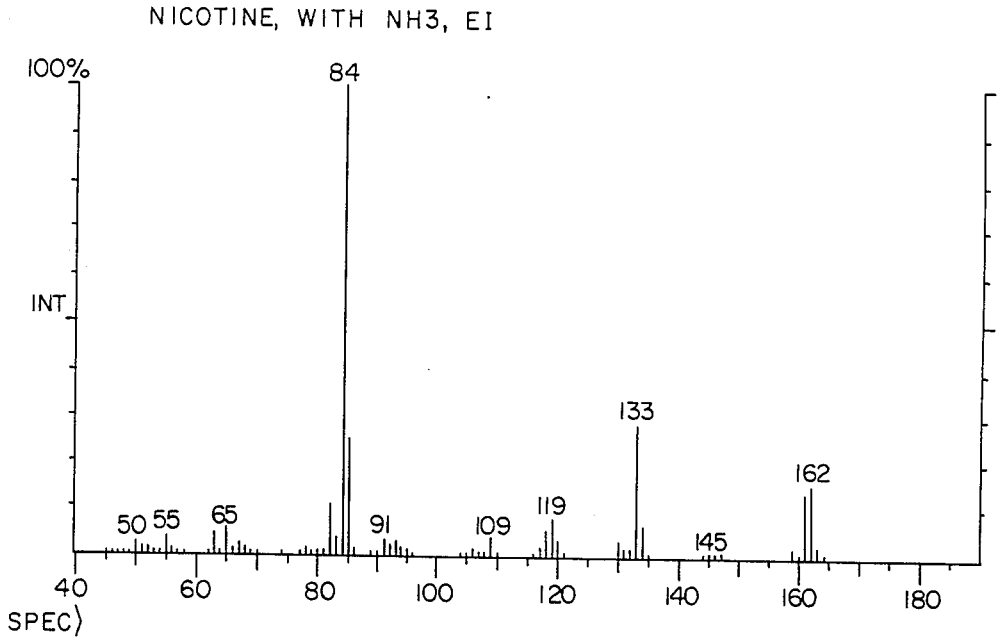
FIG. 13 shows the EI spectrum for nicotine with $NH_3$ present.
Figure 14:
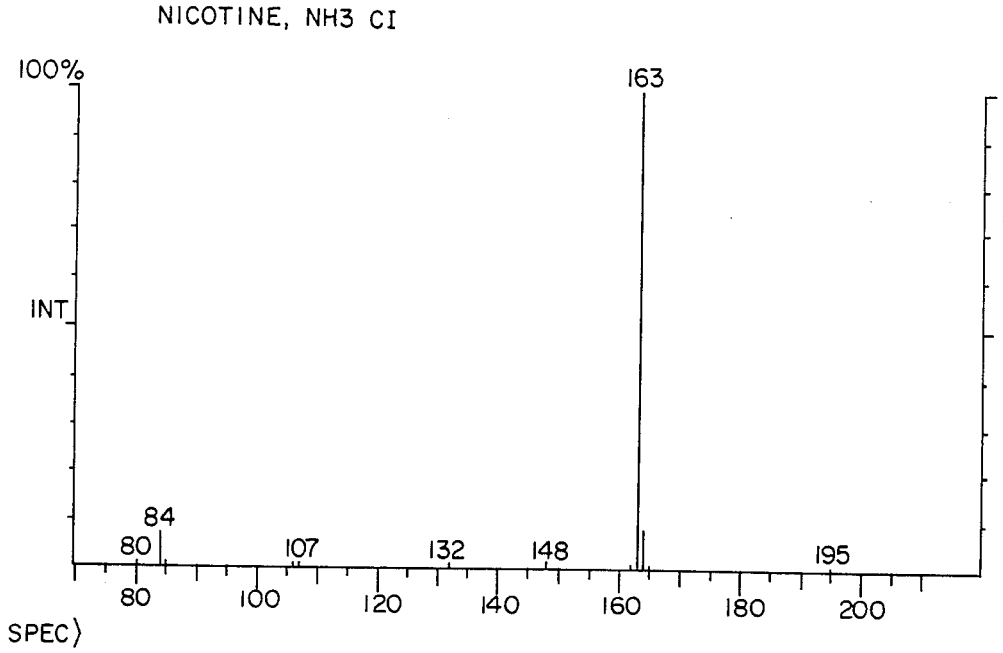
FIG. 14 shows the CI spectrum for nicotine with $NH_3$ as the reagent.
Figure 15:
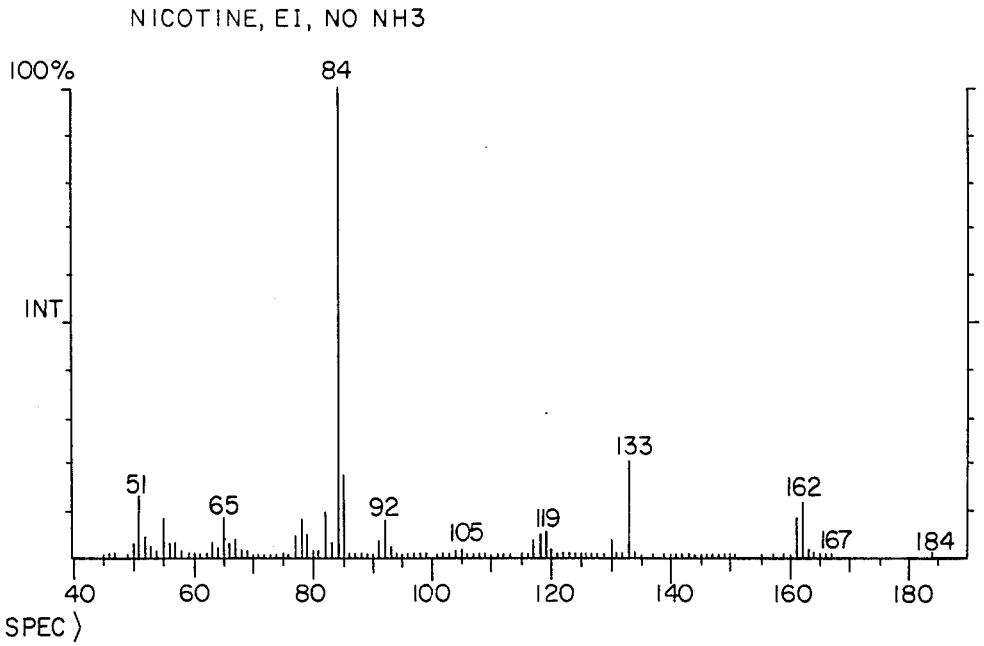
FIG. 15 shows the EI spectrum for nicotine with $NH_3$ present.
Figure 16:
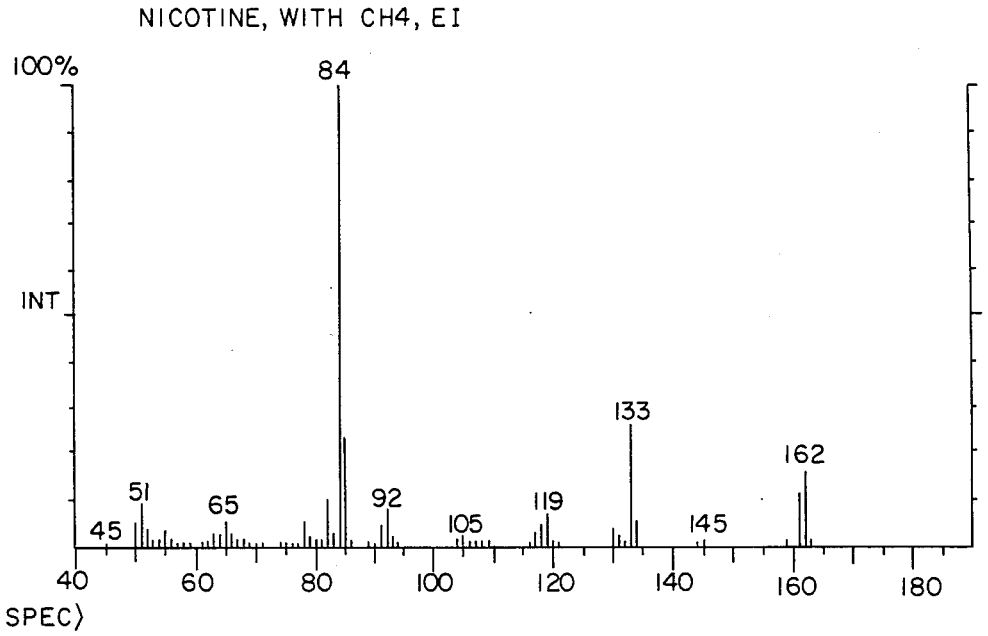
FIG. 16 shows the EI spectrum for nicotine with $CH_4$ present.
Figure 17:
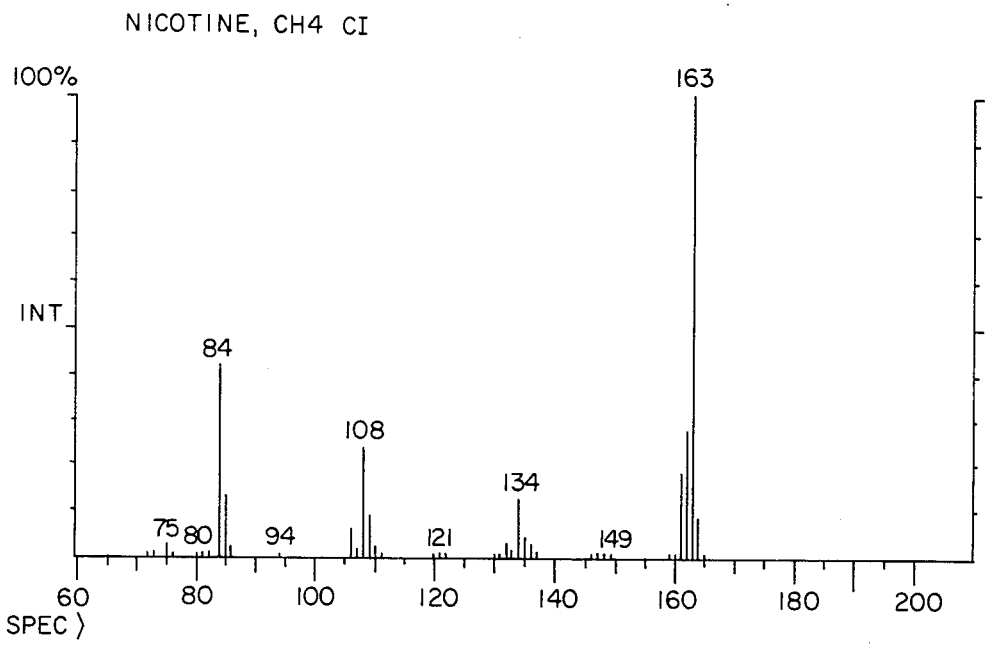
FIG. 17 shows the CI spectrum for nicotine with $CH_4$ as the reagent.

FIGS. 13–17 show mass spectra of nicotine under various conditions. In each instance the He pressure was about $2.5\times10^{-4}$ torr and the background pressure about $3.5\times10^{-7}$ FIG. 13 shows the spectrum obtained with ion impact with $NH_3$ present at about $4\times10^{-5}$ torr. FIG. 14 shows the chemical ionization spectrum for the same conditions. FIG. 15 shows the EI spectrum without $NH_3$ present. This shows substantially the same EI spectrum as with $NH_3$ present. FIG. 16 shows the EI spectrum with $CH_4$ present at about $2.5\times10^{-5}$ torr. This shows substantially the same EI spectrum. FIG. 17 shows the CI spectrum under the same conditions.

The implication of this is that by alternating scan function one can obtain in successive scans EI and CI mass spectra without changing any other parameter.

Figure 18:
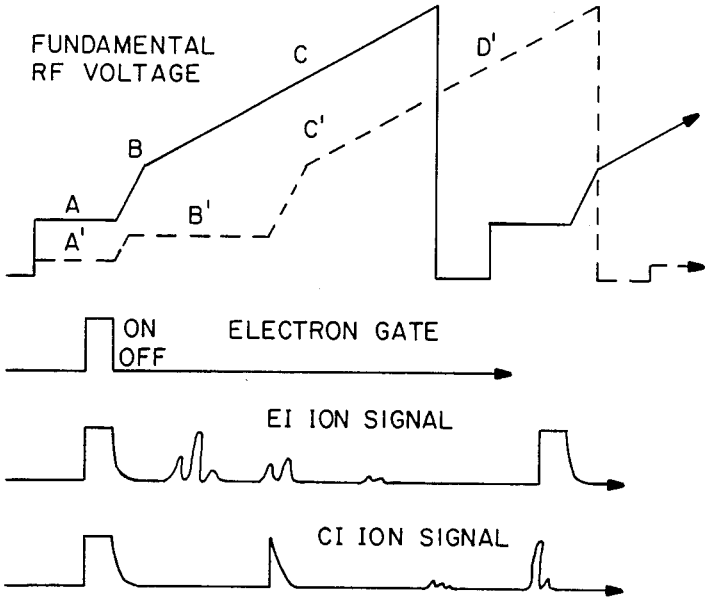
FIG. 18 shows the CI and EI scan program for mass analysis with reagent present.

FIG. 18 depicts the general scanning techniques to produce EI or CI spectra, with the continuous presence of reagent gas, using the ion trap. The EI scan function is represented by the solid line and the CI scan function is represented by the dashed line. EI spectra are produced by setting the initial RF voltage (A), during ionization, at a level such that all m/z's up to and including the molecular weight of the CI reagent gas are not stored. At this RF voltage, any radical cations or fragment ions of the reagent gas which are formed during ionization are unstable (not trappable) and very quickly, within a few RF cycles, exit the device. This does not allow for the formation of the CI reagent ions. All other ions with masses greater than the initial RF voltage level, those formed from the electron ionization of the sample, have stable trajectories and remain trapped in the device. Scanning the RF voltage (C) then results in an EI mass spectrum of the sample. As discussed earlier, CI spectra are obtained by creating reagent ions during and just after ionization (A') and then allowing the reagent ions to chemically ionize neutral sample molecules (B') to form the analyte adduct ions. Subsequent scanning of the RF voltage (D') then results in a CI mass spectrum of the sample. FIGS. 13, 14, 16 ahd 17 show EI and CI spectra with continuous reagent gas present.

This unique scheme, which uses the ion trap to perform CI and subsequent mass analysis, has several advantages: (1) Only a single device is needed. This eliminates the need for a separate ion source and mass analyzer. (2) CI reagent gas pressures are in the $10^{-5}$ torr region. Conventional CI ion sources operate at about 1 torr and require higher pumping capacity. (3) EI or CI spectra can be obtained, with the continuous presence of CI reagent gas, by simply changing the scan function. No gas pulsing or alterations to the gas conductance of the ion source are required.

The ability to achieve chemical ionization and to perform mass analysis with a quadrupole ion trap to acquire high quality mass spectra should greatly increase the availability and use of CI mass spectrometry.

What is claimed is:

1. The method of mass analyzing a sample (analyte) in a quadrupole ion trap in a chemical ionization (CI) mode which comprises the steps of introducing analyte and reagent molecules into the ion trap having a three dimensional quadrupole field in which low mass ions are stored, ionizing the mixture whereby low mass reagent ions and low mass analyte ions are trapped, changing the three dimensional field while allowing the reagent ions and analytic molecules to react to form product ions and trap higher mass product ions, scanning the three dimensional field to successively eject the product ions and detecting the product ions.

2. The method of analyzing a sample in a quadruple ion trap as in claim 1 which includes the additional steps of also analyzing the sample in the electron impact (EI) mode which comprises ionizing the analyte with the reagent molecules present while the three dimensional field is held at a level such that all masses up to and including the molecular weight of the reagent gas are not stored and the analyte ions are stored and scanning the three dimensional field to successively eject the analyte ions.

3. The method of mass analyzing a sample as in claim 1 wherein the three dimensional field is changed by changing the RF portion of the three dimensional field.

4. The method of mass analyzing a sample as in claim 2 wherein the three dimensional field is changed by changing the RF portion of the three dimensional field.

5. The method of mass analyzing as in claim 1 which includes the additional step of selecting the three dimensional field to cause the analyte ions to collide and dissociate and thereafter scanning the three dimensional field to successively eject the analytic dissociated ions.

* * * * *